United States Patent [19]

Shibasaki et al.

[11] 4,056,964

[45] Nov. 8, 1977

[54] APPARATUS FOR METAL EXTRUSION

[75] Inventors: Tadashi Shibasaki, Nagoya; Tsuguo Ieda, Kasugai, both of Japan

[73] Assignee: Sumitomo Light Metal Industries, Ltd., Tokyo, Japan

[21] Appl. No.: 640,269

[22] Filed: Jan. 15, 1976

[51] Int. Cl.[2] ..... B21C 23/04; B21C 27/00; B21C 33/00; B21C 35/06

[52] U.S. Cl. ..... 72/273; 72/255; 72/263; 72/270; 72/272

[58] Field of Search ..... 72/253-255, 72/263, 270, 272, 273

[56] References Cited

U.S. PATENT DOCUMENTS

| | | | |
|---|---|---|---|
| 2,858,017 | 10/1958 | Kent et al. | 72/263 |
| 2,894,624 | 7/1959 | Leonard | 72/273 |
| 3,369,384 | 2/1968 | Beneke et al. | 72/272 |
| 3,736,786 | 6/1973 | Wagner | 72/255 |

FOREIGN PATENT DOCUMENTS

| | | | |
|---|---|---|---|
| 572,354 | 3/1933 | Germany | 72/273 |

*Primary Examiner*—C.W. Lanham
*Assistant Examiner*—D. M. Gurley
*Attorney, Agent, or Firm*—Browdy and Neimark

[57] ABSTRACT

An improved apparatus for metal extrusion comprises a main container for receiving a billet as a material to be extruded, a press stem with a splitting disc in the front thereof for pushing the billet, a die assembly retaining a die for extruding the product, and a holding means such as a sub-container located between the main container and the die-assembly for retaining extrusion remnant or butt. An improved extrusion method is also disclosed comprising feeding the billet to the rear end of the main container by means of a billet loading means, inserting the billet into the container by means of the stem provided with a detachable disc or undetachable one in the front thereof, extruding the billet through the die by moving the stem toward the die while longitudinally splitting apart billet "shell" or crust produced during the extrusion into a plurality of strips or pieces, and retracting the stem to the original position. Each of the metal extrusion steps are repeated sequentially in the preset order.

7 Claims, 21 Drawing Figures

FIG. 2
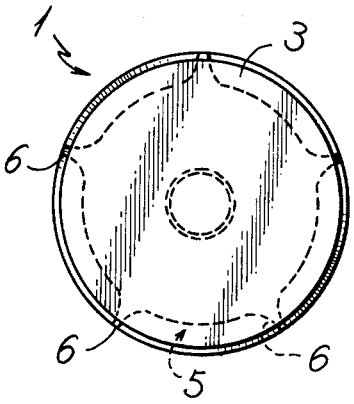
FIG. 1
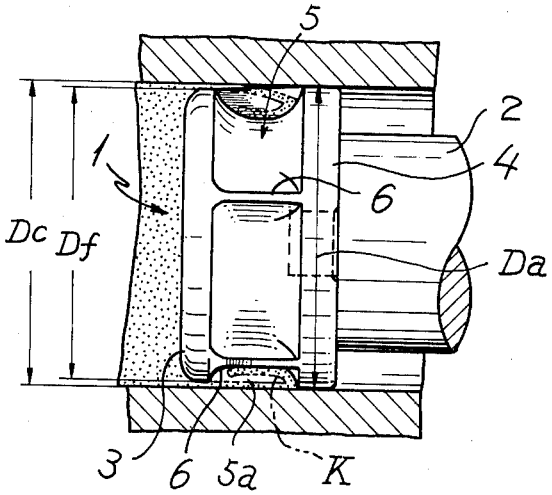
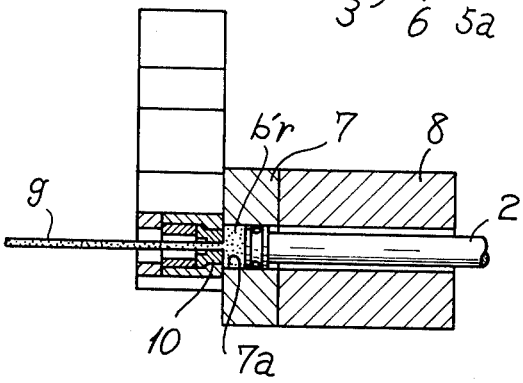
FIG. 7
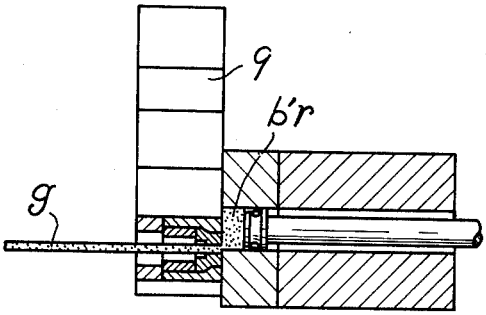
FIG. 8
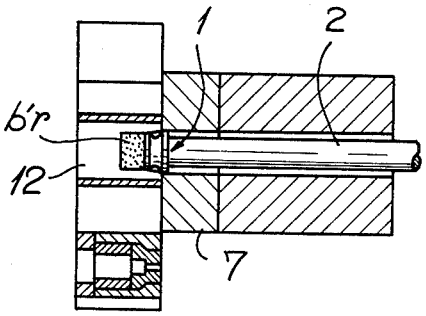
FIG. 9

APPARATUS FOR METAL EXTRUSION

FIELD OF THE INVENTION

The present invention relates to remarkable improvements in the conventional metal extrusion method and apparatus therefor by eliminating the traditional time-consuming manual operation in removing the billet shell accompanied by the metal extrusion, and by enabling highly efficient continuous operation cycles, savings of material, and a long life of the apparatus. The present invention improves, more particularly, a process of metal extrusion and the apparatus therefor by providing an annular recess or recesses on the disc and a plurality of axially disposed ribs or sharp projections for splitting apart the billet shell produced during the extrusion process, that facilitates natural removal of the split and broken shell, and thereby leads to an efficient sequential operation.

BACKGROUND OF THE INVENTION

In the press extrusion process of metal, the material to be extruded such as billet, is loaded in a container and pushed by a stem provided with a head called a dummy block whose outer diameter is a little smaller than that of the inner diameter of the container in order to leave the surface layer of the billet intentionally in the container because that portion has usually been oxidized under heating or covered with hard scale which contamination may spoil the quality of the extruded product. The remnant shell necessitates cleaning operation per every extrusion stroke, e.g., with a stem fitted with a cleaning block on the front, that hampers the continuity of the extrusion operation cycle and thereby degrades the productivity of the extrusion operation.

An improved block or disc to overcome this shortcoming has already been invented, which comprises two disc portions, front and rear, to provide an annular recess portion therebetween for receiving the shell scraped and crushed during the successive extrusion stroke of the stem. However, the annular shell accumulates over the entire periphery of the recess portion of the disc and therefore the material solidified or the "shell" is quite difficult to release per se from the disc.

On the other hand, an attempt of using a sub-container for promoting the continuation of the extrusion process has been made. However, it also needs a removal of the extrusion remnant or butt of the billet by means of a shear or other means at each stroke of extrusion. Highly efficient removing of the remnant crust or shell sticking to the container bore and the disc thus can not be said to have been solved by these devices alone. They are still imperfect in respect to efficient removal of the remnant shell and the high cycle operation of the metal extrusion press, and are far from being continuous operation of the extrusion press.

SUMMARY OF THE INVENTION

The present invention aims at a highly efficient continuous operation cycle of the metal extrusion press by contemplating a new concept of slitting or cutting the shell longitudinally during the extrusion stroke by attaching ahead of the stem a disc having a plurality of ribs or slitting projections and thereby, realizing the aim contemplated.

An object of this invention is, therefore, to use in the extrusion process and apparatus a disc comprising a plurality of disc or flange portions generating an annular recess or recesses therebetween and a plurality of axially parallel ribs disposed in the recess with the object of splitting apart the shell during the extrusion stroke to prevent the shell being annularly formed, and thereby to facilitate the shell split into strips or broken into pieces which may fall per se during the retracting stroke of the stem.

Another essential object of this invention is to provide and use in the extrusion process and apparatus a disc comprising two recess portions connected tandem and a plurality of axially parallel ribs therein, which extend from the rear end of the rear disc portion to an intermediate position of the front recess, with the object of splitting apart the shell during the extrusion stroke to prevent the shell being annually formed and thereby further to facilitate the shell being broken into pieces which may easily fall as set forth above, and preferably to provide said disc having the front recess larger in volume (both in width and depth) than the rear recess, with the object of containing the broken pieces of the shell to let the pieces fall per se from the front recess during the retracting stroke of the stem.

Another object of this invention is to provide a detachable stem and disc construction which is optional, either separably or integrally to be connected. The integral unit automatically discards the split and broken shell pieces from the recessed portion of the disc during the retracting stroke of the stem.

Still another object of this invention is to provide a holding means for stump or butt, for example, a die assembly having an integrally built-in chamber to accommodate a stump or a butt just like a sub-container in place of the sub-container.

Furthermore the following features of the present invention will be made apparent;

1. the extruded products can be continued for a considerable length, and
2. the extrusion operation cycles can be continuously repeated and also automatically controlled.

These features of the present invention are far beyond the level of the prior art extrusion methods.

BRIEF DESCRIPTION OF THE DRAWINGS

Other objects and features of the present invention will be apparent from a consideration of the following detailed description taken in conjunction with the accompanying drawings, in which:

FIG. 1 is a side elevational view of a disc used in one embodiment of the present invention.

FIG. 2 is a front-elevational view of the disc embodiment shown in FIG. 1.

FIGS. 7 to 9 are vertical cross-sectional views of essential parts showing supplementary processes in one embodiment.

DETAILED DESCRIPTION OF PREFERRED EMBODIMENTS

Figure 21:
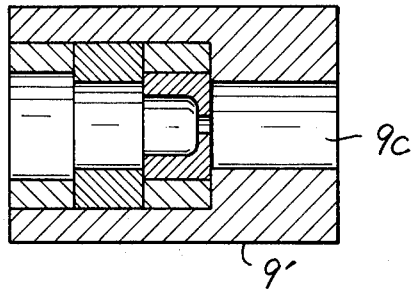
FIG. 21 is a vertical cross-sectional view of a die-assembly example usable in place of a sub-container.

In accordance with this invention, as is already evident from the above-mentioned, there are used two types of discs. One is provided with a single recess and is the subject of U.S. application Ser. No. 640,270, filed Jan. 15, 1976, assigned to the same assignee as the present application, and the other is provided with two recess portions connected in tandem. The disc and associated stem are detachable and can be employed separately or as a unitary structure fixed together. Here two embodiments will be, only for example and not for limitation, described; i.e., a first embodiment wherein a disc with a single recess employing a separated stem, and a second embodiment wherein a disc having a "double-recess" is employed with a fixed stem as a unitary structure. It is, of course, possible to employ a disc with a single recess fixed to a stem and a disc with a "double-recess" not fixed to a stem. It is also possible to use a die assembly 9', as described above, containing a built-in chamber 9c within the die assembly in replace of the sub-container as shown in FIG. 21.

In FIGS. 1 and 2, the reference numeral 1 designates a disc (pushing disc) displaced on the front end of a stem 2, the construction of which, in accordance with the first embodiment, is as follows: a front disc portion 3 having the external diameter Df which is slightly smaller than the internal diameter D*c* of the main-container bore and a rear disc portion 4 having the external diameter D*a* which is slightly larger than the external diameter D*f* of the front disc portion 3 and smaller than the internal diameter D*c* of the main-container bore are connected by an intermediate annular recess portion 5, and a plurality of axially parallel ribs 6, 6, — are disposed in the recess, which ribs circumferentially divide the recess into several spaces.

The extrusion method employing a thus constructed disc includes the following steps which are carried out in their order.

Figure 3:
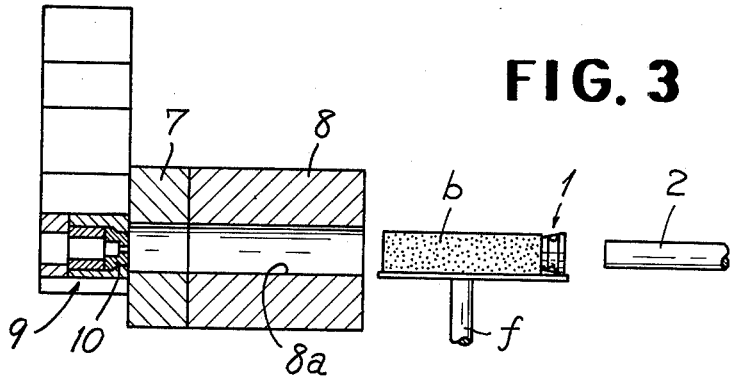
FIGS. 3 to 6 are vertical cross-sectional views of essential parts showing extrusion processes in one embodiment.

A. First of all a sub-container 7 and a main-container 8 are placed in abutment and a die assembly 9 is disposed such that the center of the die 10 is aligned with the center of the sub-container 7; a billet *b* is then raised by a billet loader *f* to the back of the main-container 8 and the disc 1 is placed to the rear end of the billet *b*, as shown in FIG. 3.

Figure 4:
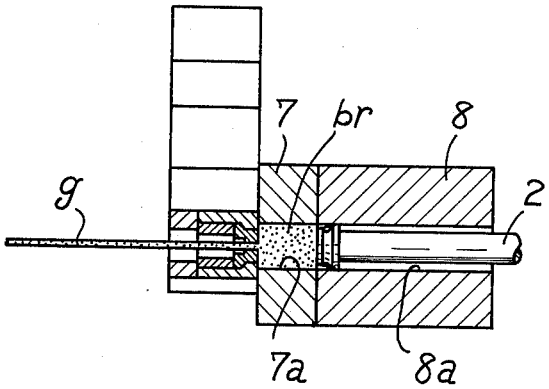

B. The billet *b* is inserted into the bore 8*a* of the main-container 8 by the movement of the stem 2, which movement continues until as the rear end of the billet *b* comes abreast with that of the sub-container 7, while the billet *b* is extruded through the die 10, as shown in FIG. 4.

During the process, a major, inner part of the billet *b* is extruded, and the remaining billet crust or shell produced on the inner wall surface of the main-container bore 8*a* is lengthwise split apart by the ribs or projections 6, 6, — of the disc 1 into several pieces. In this process of splitting, the billet shell is changed in its form from an annular single lump to several separated strips or further broken into pieces and received in each space 5*a*, 5*a*, — of the separated recess in the way indicated with the imaginary line K in FIG. 1. This means that the sticking of the remnant billet shell in the main-container bore 8*a*, is eliminated and no special sweeping operation, which has conventionally been carried out is necessitated.

Figure 5:
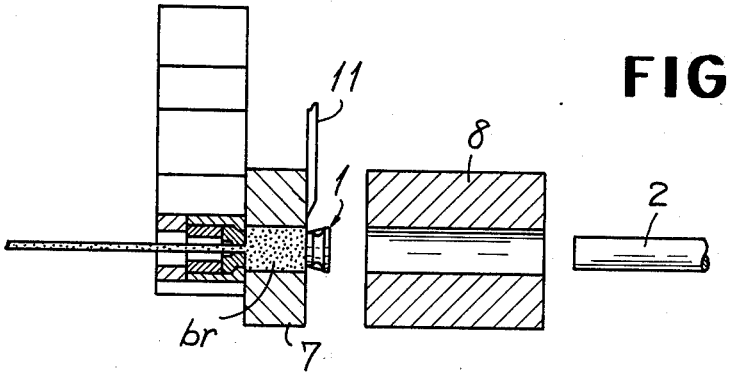

C. When the stem 2 stops at the end of the step (B), it is withdrawn along with the main-container 8, followed by the lowering of a shear 11, a removing means, along the end surface of the sub-container 7, as shown in FIG. 5.

The disc 1 is thus released from the unextruded remnant billet, or a butt *br*. In the traditional method, the removal of the remnant shell from the disc constitutes a troublesome and time-consuming process, which is mainly carried out with man-power using a hammer or other means. In the present invention, however, the billet shell received in the recess 5 is already split and separated in each space 5*a*, 5*a*, —, which largely facilitates the removal of the same. Furthermore, it is one of the essential features of this invention that the automatic removal of the billet shell in each stroke of the extrusion stem enables complete elimination of the waste shell crust whose contamination is apt to deteriorate the quality of the products.

The step of cutting off the tail of the unextruded billet, which is inherent to the traditional method, is unnecessary in the present invention. This considerably contributes to economizing of the material. The use of the shear 11 is only for convenience and not for the shearing function in this embodiment; a simple reciprocal means suffices, therefore, this purpose.

Figure 6:
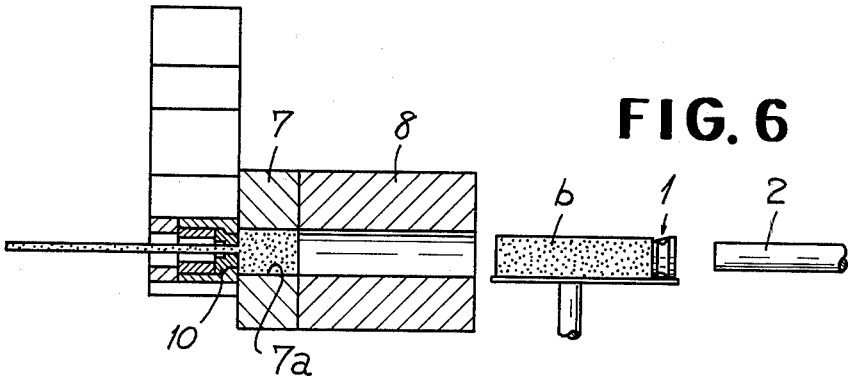

D. After removing the disc 1, the main-container 8 is placed in abutment to the sub-container 7 again, and the disc 1 is disposed touching to the end surface of the billet *b* which is raised by a billet loader for the next extrusion operation, as shown in FIG. 6.

E. The stem 2 is then moved in such a manner as the billet *b* comes abreast with the rear end of the butt or remnant billet *br* in the sub-container bore 7*a* and pre-passing is performed in both container bores 7*a* and 8*a*, if necessary. After extruding the billet *b* through the die 10, the stem 2 stops again its movement at the rear end of the sub-container bore 7*a* as shown in FIG. 4. The pre-pressing, if venting is necessary, is carried out after the main-container 8 and the stem 2 have been slightly moved back. When the venting has been finished, the main-container 8 may be moved again to the original position and the stem 2 may be advanced up to the state shown in FIG. 4.

The present invention expects in its application each of the steps from (C) to (E) to be repeated in an appropriate order, and every stroke of the stem 2, in the repeated process, includes the process of splitting apart the billet shell in the main-container bore 8*a* with the ribs 6, 6, — disposed on the disc 1, which means the billet shell produced in the main-container bore 8*a* is always automatically removed and split.

If it is necessary to remove the remnant billet butt including segregated layers which are apt to be accumulated owing to successively repeated extrusion in the sub-container bore 7*a*, the stem 2 is moved further ahead than the position in the (E) step, i.e., instead of being stopped at the rear end surface of the sub-container bore 7*a*, up to the position shown in FIG. 7, wherein remains only remnant billet butt *b'r* rich in segregated layers.

F. Thereafter, the die assembly 9 is disposed in the direction perpendicular to the direction in which the billet extruded, i.e., downward in the figure, to cut off the product *g* from the remnant billet *b'r* of the billet *b*, as shown in FIG. 8.

G. After putting in alignment the center of the remnant billet receiver 12 with that of the sub-container 7, the stem 2 is moved forward along with the remnant billet *b'r* and the disc 1 comes to ahead of the sub-container as shown in FIG. 9, so that the remnant billet *b'r* together with the disc 1 may be received by the receiver 12. The remnant billet *b'r* and the billet shell produced in the sub-container bore 7*a* can thus be easily removed from the disc 1 because the shell has already been split. After the removal of the remnant billet *b'r* and the disc 1, the stem 2 is moved back while the die assembly 9 is retracted to the original position for aligning with the center of the sub-container 7. Then another billet *b* is inserted into the bores 7*a* and 8*a* in order to start the step (A) of the successive extrusion cycle.

As to the whole process in accordance with this embodiment, after one round of the steps (A), (B), (C), (D), (E), an appropriate number of cycles of steps (C), (D), (E), for example 10, are repeated. After having repeated said 10 times of normal operation cycles a so-called cleaning process including the above-mentioned steps (F) and (G) are desired to be applied.

The present invention does not necessarily require all the steps (A) to (G) practiced in this embodiment, nor does it restrict the order of the steps described above. The essential matter of this invention resides in, after all, including a process of axially or lengthwise splitting the billet shell in the extrusion stroke of the stem. To sum up the matter, this invention facilitates the removal of the billet shell from the container bore as well as the disc, and consequently enhances the extrusion cycle and the saving of extrusion metal.

Figure 10:
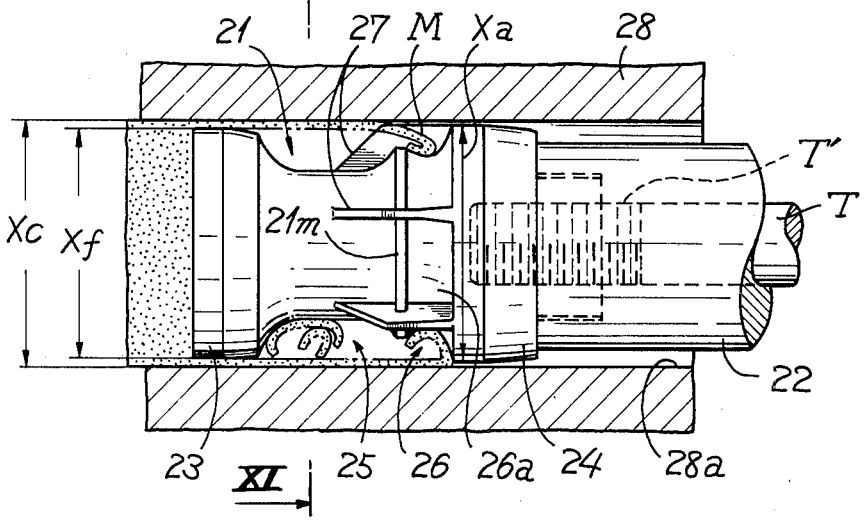
FIG. 10 is a side elevational view of a disc in accordance with the present invention.
Figure 11:
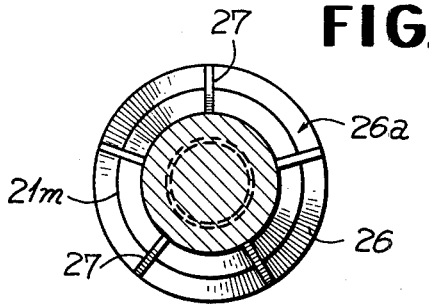
FIG. 11 is a cross-sectional view of the section XI — XI of FIG. 10.
Figure 12:
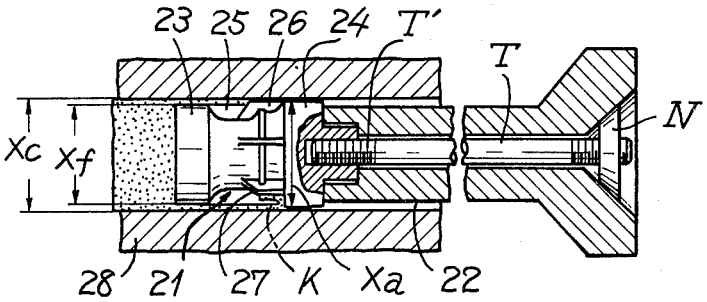
FIG. 12 is a side-elevational view of a disc attached to a stem in section in another embodiment.

In the second embodiment, a disc 21 is fixed to the front end of the stem 22, which is originally detachable, to be operated as a unitary structure; an example of the fixation can be seen in FIGS. 10 and 12, wherein a stud T having threaded tip T' connects a disc 21 to the stem 22, and the tail of the stud T is fastened to the rear opening of the stem 22 with a nut N. The structure of an disc 21 in this embodiment is as follows: a front disc portion 23 having the external diameter X*f* slightly smaller than an internal diameter X*c* of the container bore 28*a* and a rear disc portion 24 having the external diameter X*a* slightly larger than that of the front disc portion X*f* and smaller than the internal diameter X*c* of the container bore 28*a* are connected by an annular "double-recess" 25 and 26, which are located therebetween in tandem relationship and are separated by a third disc portion 21*m;* a plurality of axially parallel ribs 27, 27, — are disposed in the "double—recess," which ribs circumferentially separate a first recess 26, located before the rear disc portion 24, and the rear of a second recess 25, located behind the front disc portion 23, into several spaces; the second recess 25 is larger than the first recess 26 in volume, i.e., in both width and depth.

The method of extrusion with a disc thus constructed includes the following steps and is carried out in the following order (the direction in which the stem advances is understood as the front in this instance).

Figure 13:
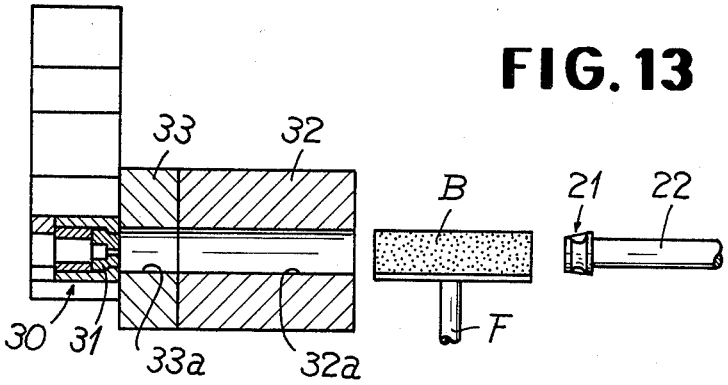
FIGS. 13 to 16 are vertical cross-sectional views of essential parts showing extrusion processes in another embodiment.

A'. First of all, a die assembly 30 is adjustingly disposed such that the center of the die 31 is aligned with the center of the sub-container 33 (the center of the sub-container is aligned with that of the main-container 32). Then a billet B is raised to the rear side of the main-container 32 by means of a billet supply means F, followed by placing a stem 22 with a disc 21 rigidly fixed on the front end thereof at the back of the billet B as shown in FIG. 13.

Figure 14:
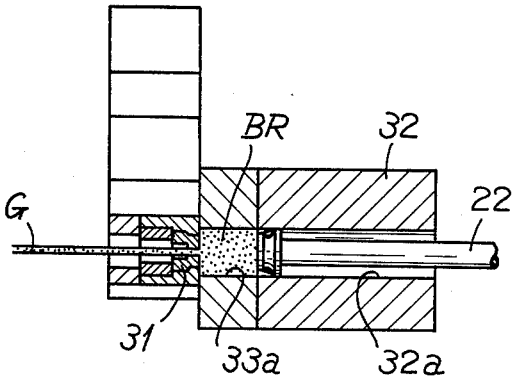

B'. The stem 22 is moved forward to insert the billet B into the bore 32*a* of the main-container 32, thereafter the stem 22 is further moved forward until the rear end of the billet B approximately comes abreast of the rear end of the sub-container bore 33*a*, as shown in FIG. 14, to extrude the billet B through the die 31. While the billet B is extruded, the ribs 27, 27, — on the disc 21 lengthwise split the billet shell produced on the inner wall of the main-container bore 32*a* into several pieces; the billet shell thus split is changed in its form from an annular lump into several separated broken pieces and received in each of the separated spaces of the rear recess 26 in the state indicated with the imaginary line as M in FIG. 10.

Figure 15:
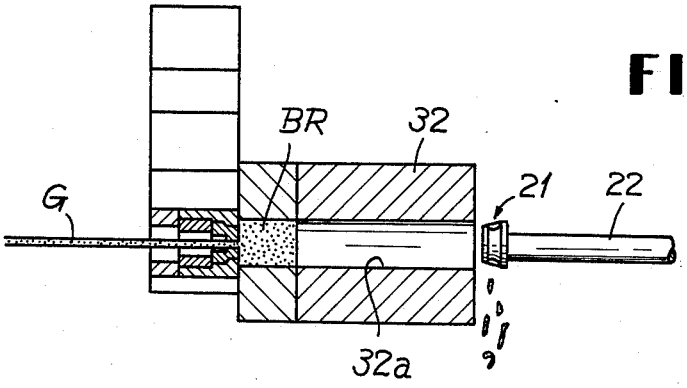
Figure 16:
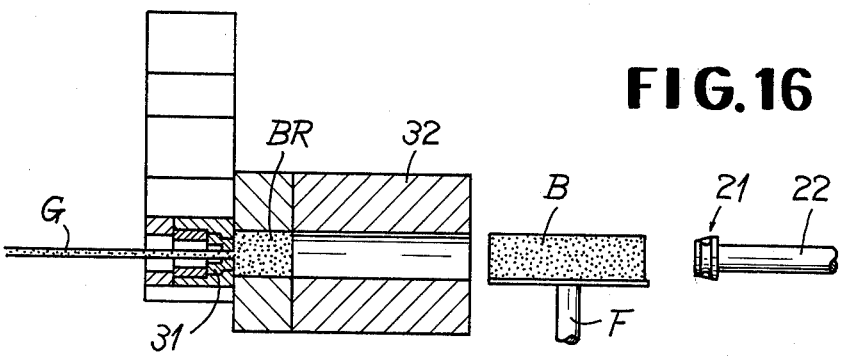

C'. After the stem 22 is stopped once in the state as shown in FIG. 14, it is moved backward to come out from the main-container 32 as shown in FIG. 15.

In the course of the retraction of the stem 22 the split shell pieces received in the rear recess 26 are moved into the second recess 25 due to the friction with the main-container bore 32*a* (during the backward stroke); and as soon as the disc 21 leaves the main-container bore 32*a* the broken shell pieces contained in the second recess 25 readily fall down naturally by gravity alone because the shell is already split and broken into pieces; and moreover they are not prevented from falling down at all as the ribs are not extending to the front portion of the front recess 25. No billet shell will, therefore, remain either in the main-container bore 32*a* or on the disc 21, and that is facilitated by applying release agent to these portions.

D'. After the removal of the billet shell another billet B is raised to be fed between the main-container 32 and the disc 21 for the next extrusion cycle.

E'. Then the stem 22 is moved forward to place said billet B in abutment with the rear end of the remnant billet in the sub-container bore 33*a* to pre-press the billets in both container bores 32*a*, 33*a;* the stem 22 is further moved forward to extrude the billet B through the die 31 before the stem is stopped at the rear end of the sub-container bore 33*a*. If venting is necessary in pre-pressing, it is performed while the main-container 32 is slightly retracted; when the venting has been finished the main-container 32 is restored to the original position. In this embodiment of the invention the normal extrusion operation cycle is completed by carrying out the steps from (C') to (E') in succession, automatically, if desired, and the cycle can be repeated also automatically, because no interruption is required for discarding the shell.

Every reciprocating stroke of the stem 22 in these repeated processes can accomplish the splitting and discarding of the billet shell in the main-container bore 32*a* automatically in this embodiment and therefore the extrusion operation cycles can be continuously repeated.

Figure 17:
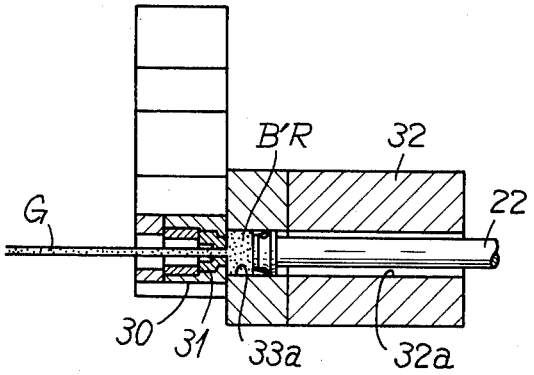
FIGS. 17 to 20 are vertical cross-sectional views of essential parts showing supplementing processes in another embodiment.
Figure 18:
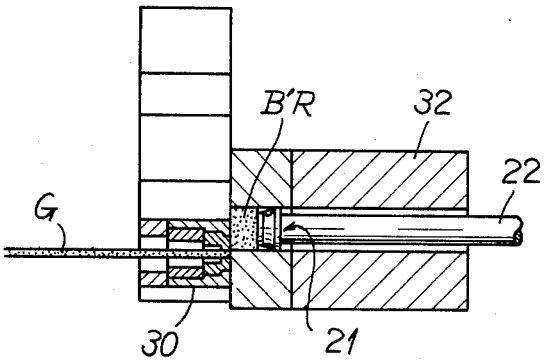

F'. When removal of the remnant billet or butt including segregated layers, which are accumulated in the sub-container bore 33*a* during repeated extrusion cycles, is required, the stem 22 is further moved forward of the position where the rear end of the butt comes abreast of the rear end of the sub-container as shown in FIG. 17, instead of being stopped at the rear end of the sub-container bore 33*a*, and the die assembly 30 is then moved in the normal direction to that of the billet extrusion (vertical in the figure) for cutting off the butt or remnant billet B'R from the product G as shown in FIG. 18.

Figure 19:
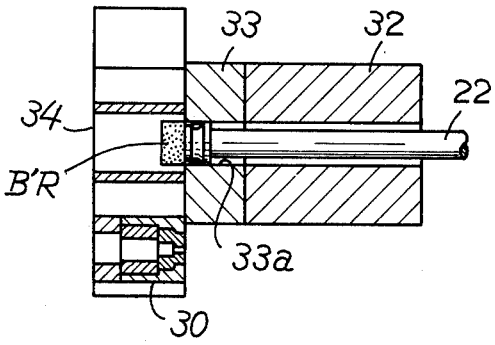

G'. After aligning the center of the remnant billet receiver 34 with that of the sub-container 33*a*, the stem 22 is advanced until the rear end of the remnant billet B'R comes abreast of the rear end of the remnant billet receiver 34 as shown in FIG. 19.

Figure 20:
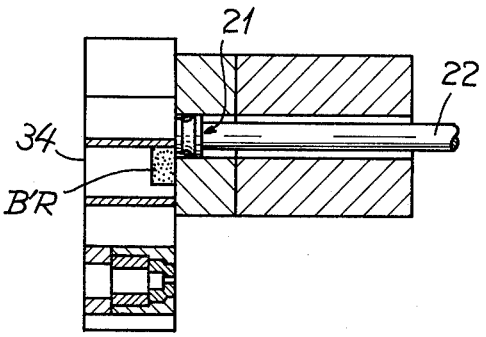

H'. When the stem 22 stops the remnant billet receiver 34 is displaced in the normal direction to that of extrusion to release the remnant billet B'R from the disc 21 as shown in FIG. 20. After removing the remnant billet B'R from the disc 21, the stem 22 is moved backward for discarding the billet shell broken pieces from the disc 21; the die assembly 30 is restored to the original position to be aligned with the center of the sub-container 33 for another charge of billet. In this way the step (A') is recycled.

As for the order of steps in this embodiment, after one round of (A'), (B'), (C'), (D'), (E') steps an appropriate number of normal cycles comprising the steps (C'), (D'), (E'), for example, 10 times are repeated. After having repeated said normal cycles 10 times or so, a so-called cleaning process including the above-mentioned steps (F'), (G') and (H') is desired to be practiced.

The present invention does not necessarily require that all the steps should be performed in this embodiment, nor does it restrict the order of the steps described above. In short, the essential matter in this embodiment is to include the step (1) of splitting the billet shell produced in the containers by means of advancing the stem, and the step (2) of removing the billet shell split and broken from the disc fixed to the stem by means of retreat movement of the stem.

In this embodiment, the billet shell which sticks to the container bore and to the disc can be easily removed by the reciprocal movement of the stem alone; and the disc does not need to be attached to the stem for each stroke because the disc is fixedly attached to the stem in this embodiment. It allows a highly efficient continuous extruding formation, which leads to an enhancement of extrusion cycle, labor saving, and material saving. Furthermore, uniformity and improvement of product quality, as a result of removal of the billet shell in each stroke are also non-negligible effects of this invention.

It should be understood that the extrusion operation during said appropriate number, e.g., 10 of normal cycles can produce a continuously extruded product.

We claim:

1. A disc for use in metal extrusion by pushing a billet in the bore of a main container through an extruder die, comprising:

a rear disc portion having an outer diameter slightly smaller than the inner diameter of the main container;

a front disc portion having an outer diameter slightly smaller than that of said rear disc portion;

a connecting portion between said front and rear disc portions;

rib means for splitting billet shell passing between the main container and said front disc portion into longitudinal strips, said rib means comprising a plurality of ribs, longitudinally disposed, circumferentially apart, said ribs extending forwardly from said rear disc portion between said connecting portion and said main container, and ending at a position substantially intermediate said two disc portions, rear recesses being defined between said rib means, said connecting portion and the main container; and a front recess defined between said rear recesses, said front disc portion, said connecting portion and the main container, said front recess being substantially in front of said rib means and having a larger volume than that of said rear recesses.

2. A disc in accordance with claim 1, wherein the wall of said connecting portion in said rear recesses in the vicinity of the intersection of said connecting portion and said rear disc portion is so curved as to cause the split billet shell to bend and break into several separated broken pieces.

3. In a metal extrusion apparatus comprising a main container having a bore to receive a billet as a material to be extruded, a loading means to feed the billet, a die through which the billet may be extruded, a die-assembly retaining said die in alignment with the bore of said main container, a holding means having a chamber for retaining an extrusion remnant or butt which has passed through said main container, a stem to push the billet in said main container through said die for extruding, and a disc disposed between said stem and the billet, the improvement wherein said disc comprises:

a rear disc portion having an outer diameter slightly smaller than the inner diameter of the main container;

a front disc portion having an outer diameter slightly smaller than that of said rear disc portion;

a connecting portion between said front and rear disc portions;

rib means for splitting billet shell passing between the main container and said front disc portion into longitudinal strips, said rib means comprising a plurality of ribs, longitudinally disposed, circumferentially apart, said ribs extending forwardly from said rear disc portion between said connecting portion and said main container, and ending at a position substantially intermediate said two disc portions, rear recesses being defined between said rib means, said connecting portion and the main container; and a front recess defined between said rear recesses, said front disc portion, said connecting portion and the main container, said front recess being substantially in front of said rib means and having a larger volume than that of said rear recesses.

4. A metal extrusion apparatus in accordance with claim 3, wherein the wall of said connecting portion in said rear recesses in the vicinity of the intersection of said connecting portion and said rear disc portion is so curved as to cause the split billet shell to bend and break into several separated broken pieces.

5. A metal extrusion apparatus in accordance with claim 3, wherein said disc is undetachably mounted on the front of said stem.

6. A metal extrusion apparatus in accordance with claim 3, wherein said die-assembly is movably arranged in the normal direction to the extruding direction, and said holding means is a sub-container disposed between said main-container and said die-assembly.

7. A metal extrusion apparatus in accordance with claim 3, wherein said holding means is a die-holder connected to said die-assembly having a chamber suitable to retain extrusion remnant or butt and said die-assembly is arranged movably in the direction normal to the extrusion direction.

* * * * *